United States Patent [19]

Land

[11] 4,147,015

[45] Apr. 3, 1979

[54] SADDLE GIRTH

[76] Inventor: Tom G. Land, P.O. Box 145, Cranfills Gap, Tex. 76637

[21] Appl. No.: 775,171

[22] Filed: Mar. 7, 1977

[51] Int. Cl.[2] ..... B68C 1/14

[52] U.S. Cl. ..... 54/23

[58] Field of Search ..... 54/4, 23, 24, 34, 35, 54/44, 46, 57, 66, 69, 87

[56] References Cited

U.S. PATENT DOCUMENTS

| | | | |
|---|---|---|---|
| 751,953 | 2/1904 | Shuster | 54/52 |
| 1,531,672 | 3/1925 | McLean | 54/46 X |
| 2,066,855 | 1/1937 | Robertson | 54/23 |
| 2,252,257 | 8/1941 | Harvey | 54/23 X |
| 3,828,521 | 8/1974 | Dulaney | 54/23 |

*Primary Examiner*—Louis G. Mancene
*Assistant Examiner*—Robert P. Swiatek
*Attorney, Agent, or Firm*—Richards, Harris & Medlock

[57] ABSTRACT

The specification discloses a saddle girth in which a webbing member is formed into a loop by joining the ends together. A pair of girth buckles are attached to the loop along with buckle overlap and padding members to form a high strength saddle girth.

6 Claims, 7 Drawing Figures

SADDLE GIRTH

FIELD OF THE INVENTION

This invention relates to saddlery and harnesses, and more particularly to a saddle girth utilizing a webbing member joined at its ends to form a loop structure to provide improved strength and wear characteristics.

DESCRIPTION OF THE PRIOR ART

A saddle girth serves the purpose of holding a saddle in place on the back of a horse and existing girths are classified into two basic categories, the Western style and the English style.

The Western style girth generally consists of two circular iron rings joined by a plurality of individual line members with each end of the member tied to one of the iron rings. Each of the iron rings is connected to a saddle strap or billet which in turn is secured to the saddle. The individual line members are usually made of leather, cotton or synthetic fiber. In some cases the ring includes a tongue member to form a girth buckle.

English style girths, on the other hand, usually consist of a single member with either two or three small buckles on each end. One English style is the three-fold leather girth which has a single leather member having two longitudinal folds to form the three layers. A second English style is the Balding girth having a single leather member split into three parallel segments but still having two buckles at each end. Another English style is the Lonsdale girth which has the three-fold leather structure but with a pair of buckles attached at each end so as to overlap the leather body. English style girths have also been built using cord and woolen fabric, as well as leather.

When in use all of the above-mentioned girths are subject to substantial tensile stresses and particularly to stress in the buckle and buckle-joining area. The Western style girth subjects the cord members to substantial frictional wear due to the flexing of the ring in relation to the cord. And in the English style the buckle members are sewn to the girth body thus the thread joining the members is subject to the full tension force.

Existing saddle girth designs are susceptible to structural failure especially with heavy or extended use and such a failure can subject the rider to serious injury. Thus there exists a need for a saddle girth design with increased strength and greater resistance to frictional wear.

SUMMARY OF THE INVENTION

The present invention provides an improved saddle girth which exhibits greater strength than existing designs and has more resistance to wear.

In accordance with the present invention an improved saddle girth is made by joining the ends of a webbing member together after having inserted the member through two girth rings or buckles. A second webbing member is sewn to the loop and made to extend beyond the buckles thereby adding strength and providing buckle overlaps. Padding is then sewn to the girth to prevent it from irritating the animal. Buckle covers are also provided as an additional feature of the girth of the present invention.

BRIEF DESCRIPTION OF THE DRAWINGS

For a more complete understanding of the present invention and further objects and advantages thereof, reference is now made to the following description taken in conjunction with the following drawings.

DESCRIPTION OF THE INVENTION

Figure 1:
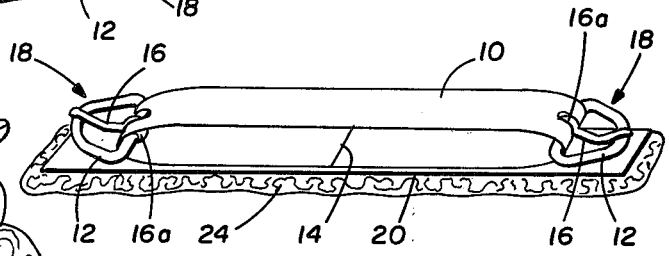
FIG. 1 is a perspective view of the first embodiment of the present invention.

The basic embodiment of the present invention is shown in FIG. 1 where a loop 10 is formed by joining together the ends of a unitary webbing member at junction 14. The unitary webbing member forming loop 10 can be comprised of either a single ply or a plurality of plies of webbing material. Loop 10 is passed through girth rings 12 to thereby form a stress bearing member connecting the two girth rings 12. Buckle tongues 16 are connected to the girth rings 12 on the interior of the loop 10 and passed through holes **16*a* formed in the loop 10 to form girth buckles 18**.

The embodiment of the invention as shown in FIG. 1 includes a padding member 24 sewn to unitary webbing member 20. Member 24 can be any form of padding but particular desirable materials are artificial fleece and sheepskin. This padding evenly distributes the load stresses and provides air circulation thus enhancing the wearing comfort for the animal and preventing girth galls.

Figure 2:
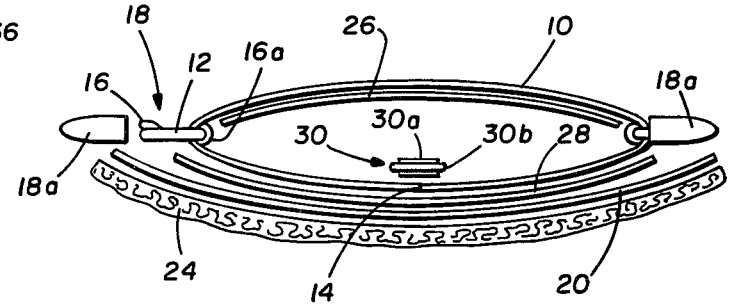
FIG. 2 is an exploded side view of the preferred embodiment of the present invention.

FIG. 2 shows an exploded view of the preferred embodiment of the present invention. The structure is that shown in FIG. 1 with the addition of stiffening members 26 and 28 and "D" ring structure 30.

Stiffening member 26 is sewn to the upper half of the loop 10 to pad or stuff the upper half of loop 10 and to add structural rigidity to the overall body connecting the girth buckles 18. Stiffening member 28 is sewn between the unitary webbing member 20 and the bottom half of the loop 10 to perform the same padding and rigidity function for the lower half of loop 10. Stiffening members 26 and 28 have lesser width than the unitary webbing member forming loop 10.

"D" ring structure 30 comprises a webbing member **30*a* sewn transversely to the midportion of the lower half of the loop 10 and having "D" rings 30*b* connected to the ends of member 30*a***.

The preferred structural material for the hardware members comprising buckle 18 and "D" ring **30*b*** is stainless steel. This material enhances the useful life of the saddle girth since it is resistant to deterioration and corrosion due to exposure of the girth to weather, perspiration and machine washing.

Buckle covers **18*a* are provided to enclose the buckles 18** when the girth is being machine washed to prevent damage to the interior of the washing machine.

Figure 3:
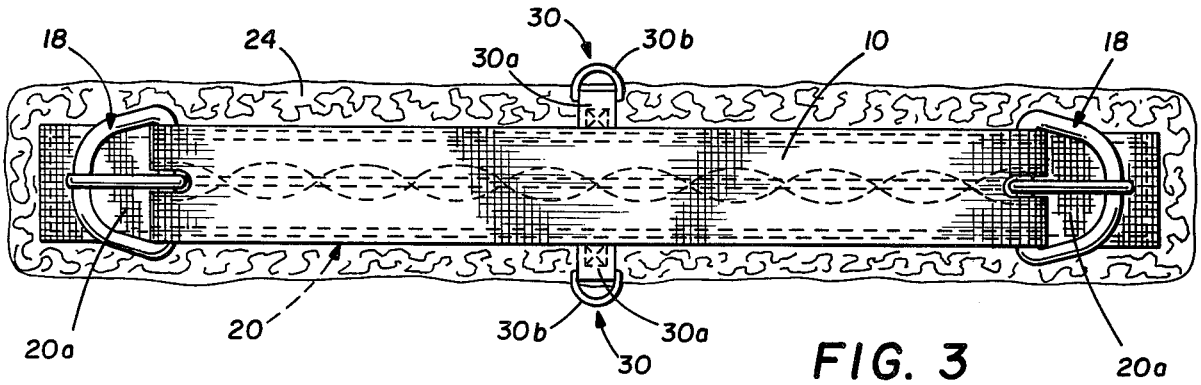
FIG. 3 is a plan view of the preferred embodiment of the present invention.

The preferred embodiment of the invention as shown in FIG. 2 is displayed in a plan view in FIG. 3. The "D" rings **30*b* provide connection points for a martingale and a girth spacer. The two halves of the loop 10 along with the unitary member 20 and the stiffeners 26 and 28** and the padding member 24 are all sewn together to form a single unit which connects the two girth buckles 18.

Figure 4:
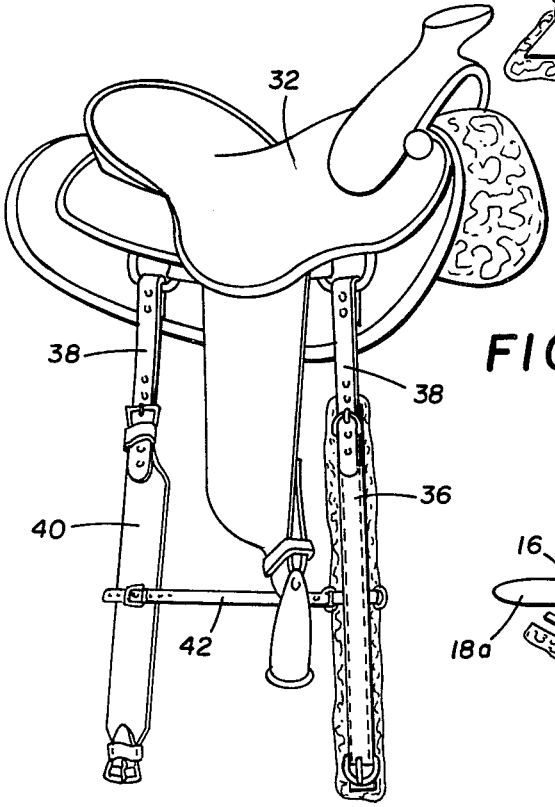
FIG. 4 is a perspective view of the present invention showing its attachment to a saddle.

FIG. 4 shows the present invention 36 as it is connected to a saddle 32 by means of a saddle billet 38. A flank girth 40 is also connected to saddle 32 by means of a saddle billet 38. Girth spacer 42 maintains the girths in the proper position. In use, the free ends of flank girth 40 and saddle girth 36 shown in FIG. 4 are drawn under the belly of the horse and connected to saddle billets on the opposite side of the saddle.

Figure 5:
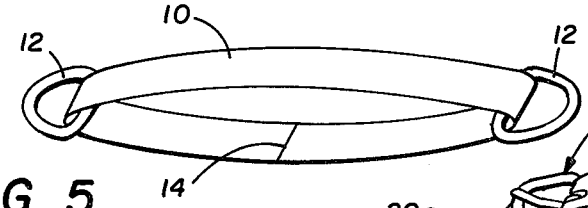
FIG. 5 is a perspective view of a third embodiment of the present invention.

A third embodiment of the present invention is shown in FIG. 5. This embodiment comprises a loop 10 of webbing material which has been passed through girth rings 12 with the ends joined together at junction 14.

Figure 6:
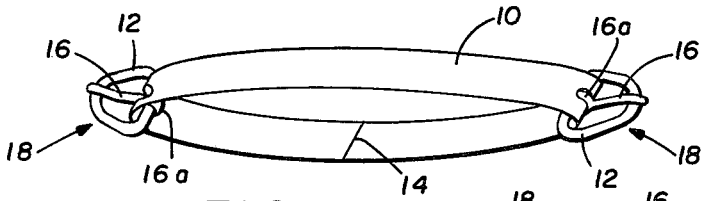
FIG. 6 is a perspective view of a fourth embodiment of the present invention.

A fourth embodiment of the present invention is shown in FIG. 6. This embodiment is that shown in FIG. 5 with the addition of buckle tongue members 16 to girth rings 12 to form girth buckles 18. Buckle tongues 16 are passed through holes 16*a*.

Figure 7:
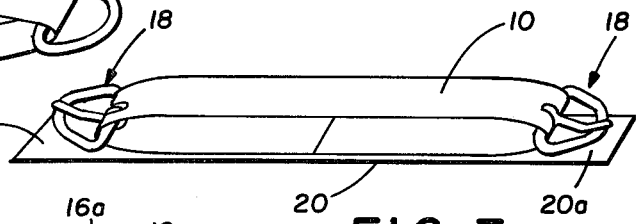
FIG. 7 is a perspective view of a fifth embodiment of the present invention.

FIG. 7 shows a fifth embodiment of the invention where a second unitary webbing member 20 is joined to the structure shown in FIG. 6. Unitary webbing member 20 is sewn to the loop 10 on the side of the girth buckles 18 opposite the buckle tongues 16. This member provides additional tensile strength to the girth and forms buckle overlaps 20*a* which prevent the girth buckles 18 from irritating the animal.

Although several embodiments of the invention have been illustrated in the accompanying drawings and described in the foregoing detailed description, it will be understood that the invention is not limited to the embodiments disclosed, but is capable of numerous rearrangements, modifications and substitutions of materials without departing from the scope of the invention.

What is claimed is:

1. A saddle girth which passes under the belly of a horse and is connected to saddle billets to hold a saddle in place on the horse's back, the combination comprising:

(a) a first elongate fabric member, (b) a second fabric member sewn to each of the end regions of said first member, the ends of said first member butted together forming said first member into a closed loop, (c) a pair of cinch buckles, each comprising a D-ring and a buckle tongue, each said D-ring encircling said first member and said buckle tongues passing through holes formed at opposite points on said loop, said cinch buckles held in place by sections of said first member joined together on each side of said holes and (d) a fleece pad sewn to an outer surface of said second fabric member and extending beyond the sides of said loop and beyond each said cinch buckle for uniformly distributing the tension of said girth on the horse and for protecting the horse from irritation by said cinch buckles.

2. A saddle girth as recited in claim 1 further including a second pair of D-rings joined to said first member at a center portion between said cinch buckles, said second pair of D-rings disposed at opposite edges of said first member to provide attachment points for other saddlery articles.

3. A saddle girth as recited in claim 1 further including a fabric stiffener member sewn to said first member within said loop for making the saddle girth more rigid.

4. A saddle girth which passes under the belly of a horse and is connected to saddle billets to hold a saddle in place on the horse's back, the saddle girth being machine washable, comprising in combination:

(a) a first elongate synthetic fabric member, (b) a second synthetic fabric member sewn to each of the end regions of said first member, the ends of said first member butted together forming said member into a closed loop, (c) a pair of cinch buckles, each comprising a D-ring and a buckle tongue, said D-rings encircling said first member and said buckle tongues passing through holes formed at opposite points on said loop, said cinch buckles held in place by sections of said first member joined together on each side of said holes, (d) a synthetic fleece pad sewn to an outer surface of said second fabric member and extending beyond the sides of said loop and beyond each cinch buckle for uniformly distributing the tension of the girth on the horse and for protecting the horse from irritation by said cinch buckles, and (e) padded, removable buckle covers enclosing each of said cinch buckles for protecting the interior of a washing machine from damage by said cinch buckles when said saddle girth is machine washed.

5. A saddle girth as recited in claim 4 further including a second pair of D-rings joined to said first member at a center portion between said cinch buckles, said second pair of D-rings disposed at opposite edges of said first member to provide attachment points for other saddlery articles.

6. A saddle girth as recited in claim 4 further including a synthetic fabric stiffener member sewn to said first member within said loop for making the saddle girth more rigid.

* * * * *